United States Patent [19]

Kennard et al.

[11] 3,983,936

[45] Oct. 5, 1976

[54] METHOD OF AND APPARATUS FOR CUTTING AND RECOVERING OF SUBMARINE SURFACE CASING

[75] Inventors: Thomas A. Kennard; Jimmy R. Keyes, both of Houston, Tex.

[73] Assignee: A-Z International Tool Company, Houston, Tex.

[22] Filed: June 2, 1975

[21] Appl. No.: 583,053

[52] U.S. Cl. ..... 166/.5; 166/55.8; 166/98

[51] Int. Cl.[2] ..... E21B 29/00

[58] Field of Search ..... 166/.5, 66, 55, 55.7, 166/55.8, 98, 297, 298, .6

[56] References Cited

UNITED STATES PATENTS

| | | | |
|---|---|---|---|
| 1,830,207 | 11/1931 | Mueller | 166/55.7 |
| 2,261,564 | 11/1941 | Robichaux et al. | 166/298 |
| 2,640,537 | 6/1953 | Edwards | 166/55.8 |
| 3,301,324 | 1/1967 | Smith | 166/.5 |
| 3,338,305 | 8/1967 | Pittman et al. | 166/.5 X |
| 3,376,927 | 4/1968 | Brown | 166/.5 |
| 3,378,072 | 4/1968 | Smith | 166/55.8 |

*Primary Examiner*—Ernest R. Purser
*Assistant Examiner*—Richard E. Favreau
*Attorney, Agent, or Firm*—Vinson, Elkins, Searls, Connally & Smith

[57] ABSTRACT

The method of and apparatus for cutting and recovering submarine surface casing and associated equipment on the ocean floor included the steps of lowering a string into the surface casing which string includes a swivel, a spear and a cutter, seating the swivel on the casing well head seat, actuating the cutter to sever the casing, setting the spear within the casing and recovering the surface casing and well head equipment associated therewith.

7 Claims, 6 Drawing Figures

METHOD OF AND APPARATUS FOR CUTTING AND RECOVERING OF SUBMARINE SURFACE CASING

BACKGROUND OF THE INVENTION

In the drilling of wells offshore it is desirable, and in many locations required, that the surface casing and all equipment on the ocean floor be removed to avoid the hazard of equipment projecting above the ocean floor. Prior to the present invention it has been the practice to lower a cutter on a string to cut through the surface casing at a point substantially below the ocean floor, the string is recovered, the cutter replaced with a spear, the string is lowered, the wellhead is located to insert the spear into the surface casing, the spear is set and the casing and other equipment on the ocean floor raised on the string.

SUMMARY

The present invention relates to an improved method of and apparatus for recovering submarine surface casing and its guide base from the ocean floor.

An object of the present invention is to provide an improved method of recovering submarine surface casing and other ocean floor equipment with a single round trip of the drill string.

Another object of the present invention is to provide an improved method of and apparatus for recovering submarine surface casing which is simpler and less expensive than the method and apparatus of the prior art.

A further object of the present invention is to provide an improved method of and apparatus for recovering submarine well casing which requires a minimum of relocation of the well head for insertion of the string therein.

BRIEF DESCRIPTION OF THE DRAWINGS

These and other objects and advantages are hereinafter set forth and explained with reference to the drawings wherein.

DESCRIPTION OF THE PREFERRED EMBODIMENT

Figure 1:
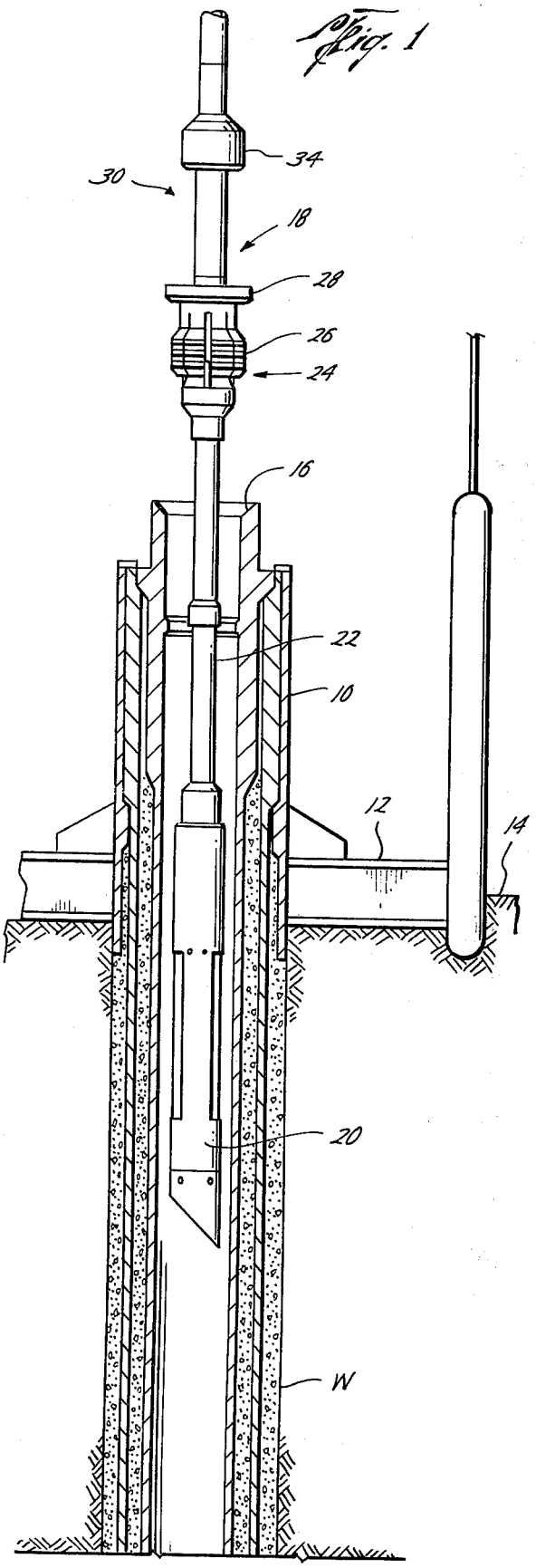
FIG. 1 is sectional view of a submarine well with the improved string of the present invention being run into the surface casing.

In FIG. 1, a submarine well W which has been drilled and has surface casing 10 set in place and a temporary guide base 12 resting on the ocean floor 14. The upper open end of surface casing 10 defines a well head seat 16.

The improved string 18 of the present invention is shown in FIG. 1 being inserted into the surface casing 10. The string 18 includes the cutter 20 supported by the sub 22 from the spear 24. The gripping elements 26 of the spear 24 depend from a swivel ring 28. Swivel 30 is connected above spear 24 and is adapted to rotate within ring 28 when the ring 28 is seated on well head seat 16. The string 18 also includes a telescoping joint 32 above the swivel body 34. The string 18 extends to the surface (not shown) where it is suitably manipulated as hereinafter described.

Figure 2:
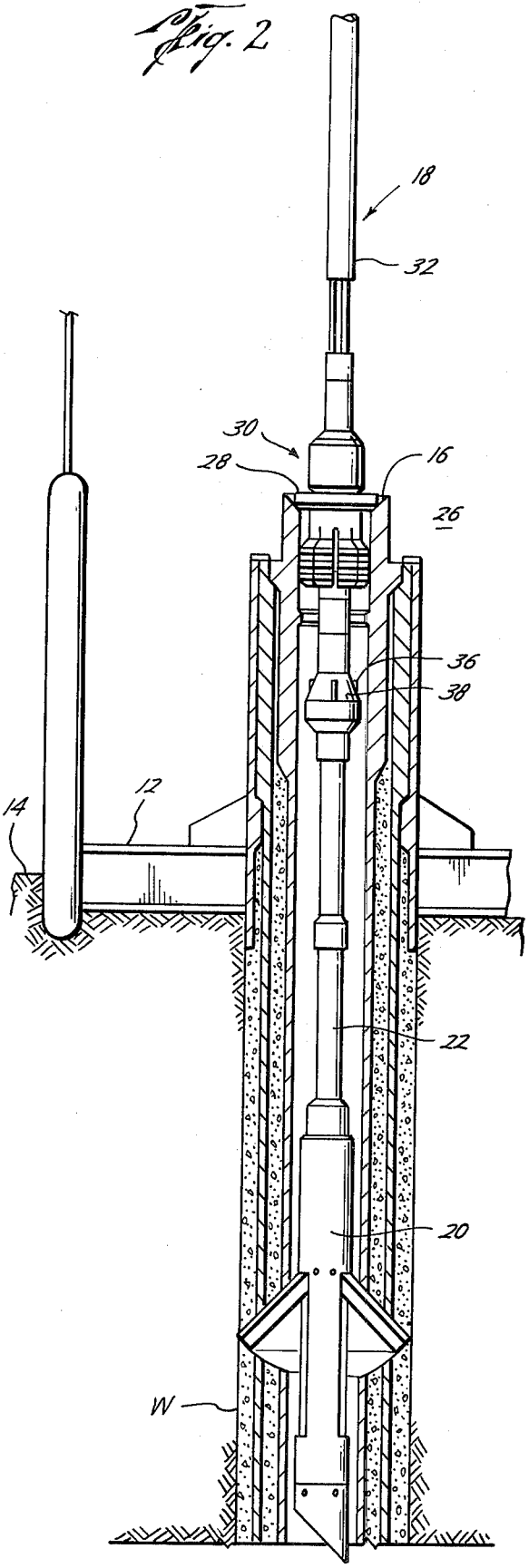
FIG. 2 is a similar view showing the cutting of the surface casing.

The string 18 is lowered into the interior of the surface casing 10 until the swivel ring 28 engages on the well head seat 16 and the swivel body 34 engages ring 28 as shown in FIG. 2. This position allows the string 18 to be rotated with the lower end thereof being supported so that vertical movement of the upper end of the string 18 is not transmitted to the cutter 20 but is taken up by the telescoping joint 32.

Figure 3:
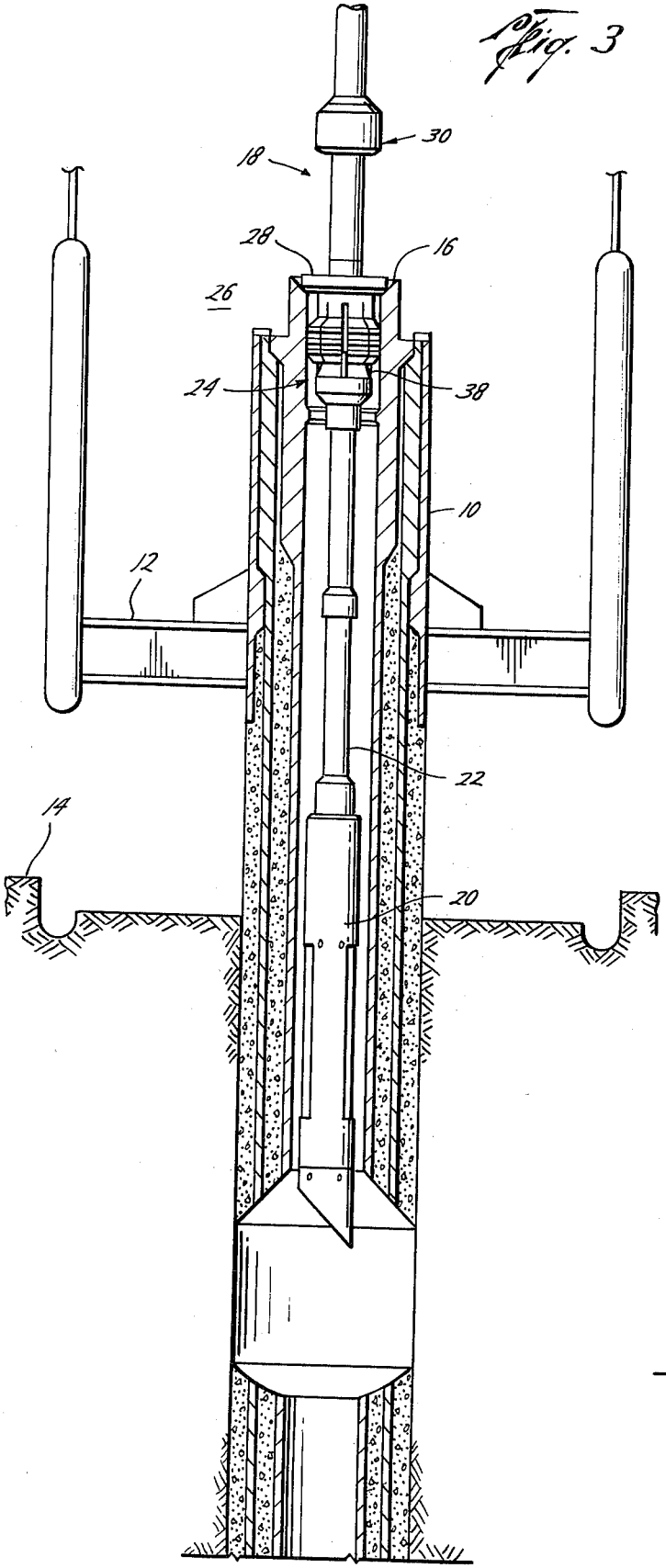
FIG. 3 is another similar view showing the recovery of the surface casing and temporary guide base.

Flow through the string 18 is commenced which extends the cutting arms on cutter 20 and the string 18 is rotated so that cutter 20 cuts through the surface casing 10. When cutting is complete as shown in FIG. 3, flow through and rotation of the string 18 is stopped and the string 18 is manipulated and raised so that spear 24 sets the gripping elements 26 within the surface casing 10. The manipulation involves the positioning of the stops 36 in alignment with the spaces between the gripping elements 26 so that the tapered portion 38 of the spear 24 moves beneath the gripping elements 26 causing them to be moved outwardly into set position within the surface casing 10.

With the spear 24 set, raising the string 18 raises the cut portion of the surface casing 10 and the temporary guide base 12 which is secured to the surface casing 10. As the string 18 is lifted the surface casing 10, the temporary guide base 12 and any other equipment on the ocean floor 14 secured to the base 12 or casing 10 is recovered. This leaves the well W with no projections above the ocean floor.

Figure 4C:
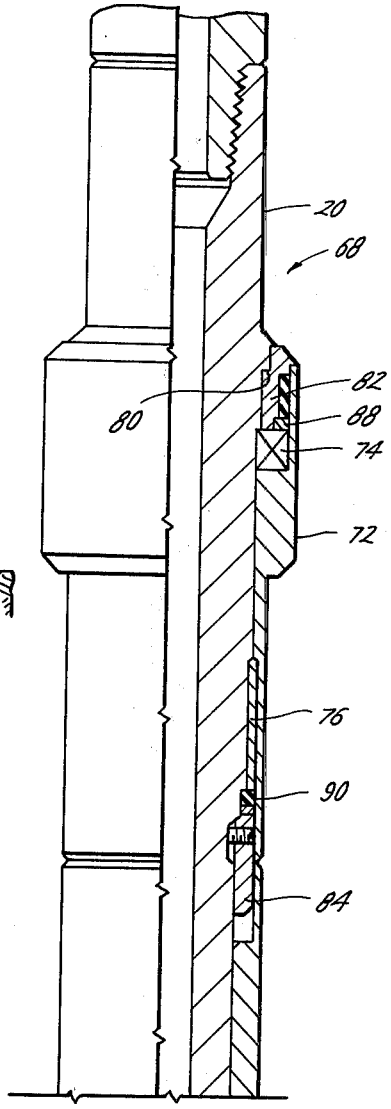
FIG. 4C is a partial sectional view of the swivel.
Figure 4A:
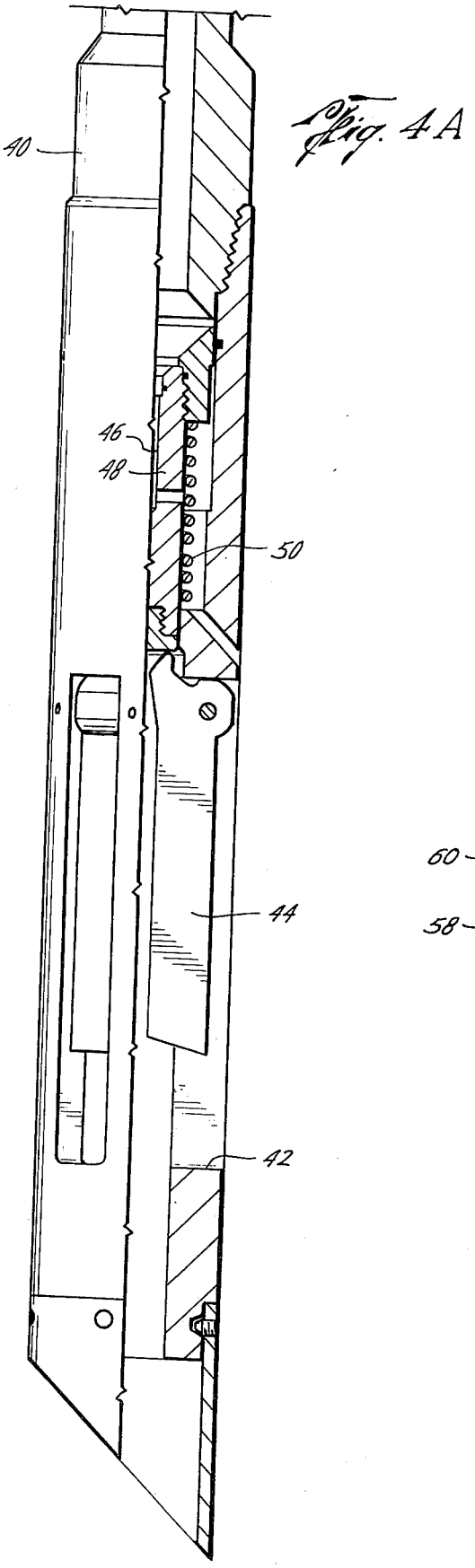
FIG. 4A is a partial sectional view of the cutter.

The structure of the cutter 20 as shown in FIG. 4A includes the body 40 having windows 42 defined in its lower portion and the cutting blades 44 pivotally mounted to body 40 for outward movement through windows 42 into cutting position. Movement of the cutting blades 44 is responsive to flow through cutter 20 and results from the restriction to flow created by orifice 46 supported on piston 48 which is biased by spring 50 upwardly. When a sufficient pressure drop occurs across orifice 46, piston 48 moves downwardly, forcing the cutting blades 44 outwardly. When flow is interrupted the spring 50 returns piston 48 to its upper position relieving the blades 44 of outward force to terminate cutting and allowing blades 44 to retract.

Figure 4B:
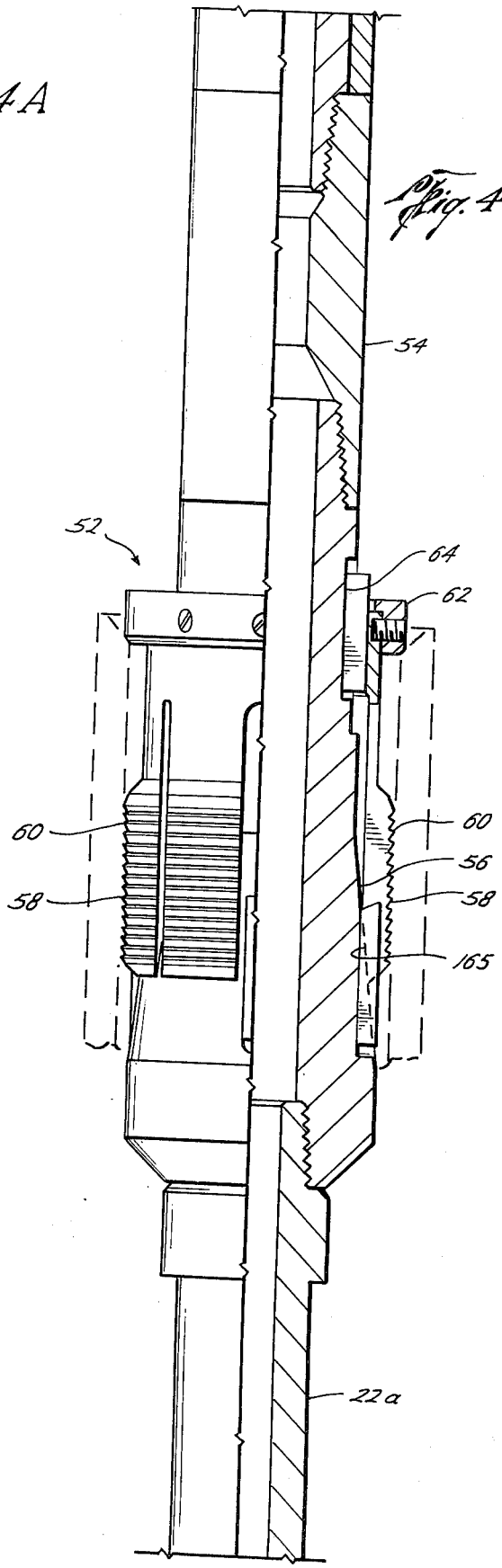
FIG. 4B is a partial sectional view of the spear.

The spear assembly 52 shown in FIG. 4B includes the tubular body 54 the lower end of which includes a downward and outward taper 56 with stops 58 mounted thereon and is adapted to be connected to the sub 22*a*. The gripping elements 60 extend from the ring 62 which is positioned around the reduced diameter portion 64 of body 54. The lower inner surfaces 65 of the gripping elements 60 are tapered and adapted to slide on the taper 56. The stops 58 are positioned so that they may be engaged by the lower ends of the gripping elements 60 to prevent setting of the spear assembly 52 and may be received in the spaces between the gripping elements 60 so that the gripping elements 60 ride downward and outward on taper 56 to their set position.

The swivel assembly 68 shown in FIG. 4C includes the tubular body 70 which is adapted to be connected at its lower end by a sub or directly to the spear assembly 52 and at its upper end to the telescoping joint 32 or other portion of the string 18.

The swivel assembly 68 as previously explained is adapted to engage the well head seat 16 for support of the string 18 to allow vertical motion of the floating platform from which the string 18 is operated to be compensated by the telescoping joint 32. The swivel collar 72 surrounds the joint and is supported by the thrust bearing 74, and the radial bearing 76. The ring 62 which is adapted to engage the seat 16 is adapted to be positioned around the exterior of the lower portion of the collar 72. The collar 72 is retained between the upper shoulder 80 on the body 70 which is engaged by the packing ring 82 and the bearing preload ring 84.

From this structure as is clearly shown in FIG. 4C it can be seen that the drill string 18 can be rotated within the swivel collar 72 and ring 62. Further, the bearing areas are protected by the upper packing 88 and the lower packing 90 so that both bearings 74 and 76 may be properly lubricated at all times.

From the foregoing it can be seen that the present invention provides an improved method and apparatus for recovering a submarine surface casing and other equipment on the ocean floor in a single round trip of the drill string and without the use of complicated equipment.

What is claimed is:

1. The method of cutting and recovering a submarine surface casing and guide base from the ocean floor including the steps of lowering a string including a flow actuated casing cutter, a swivel and a spear into the submarine surface casing and seating the swivel on the well head seat defined in the submarine surface casing and with the cutter within the submarine surface casing below the well head seat, cutting through the submarine surface casing with said casing cutter at a point below the ocean floor rotating the string to orient the stops on said spear into alignment with the spaces between the gripping elements of the spear, raising the string to move a tapered body portion under the gripping elements whereby said gripping elements are forced outwardly into gripping engagement with the interior of the surface casing above the cut without removing the string from said submarine surface casing, and lifting said string to recover said cut portion of said submarine surface casing and the guide base.

2. The method according to claim 1 wherein said cutting step includes actuating the cutter blades of said casing cutter, and rotating the string to cut through the surface casing.

3. The method according to claim 2 wherein said blade actuating step includes circulating a fluid through the string.

4. An apparatus for cutting and recovering a submarine surface casing and guide base from the ocean floor, comprising a well string, a casing cutter connected to the lower end of the well string, a swivel ring adapted to seat on the well head seat defined by the submarine surface casing, a swivel body secured to said well string, and being adapted to rotate in engagement with said swivel ring, a spear body secured to said well string below said swivel ring and having tapered surfaces thereon, said swivel ring being movably mounted on said well string between said swivel body and said spear body, and a plurality of gripping elements flexibly depending from said swivel ring and having an inner surface coacting with the tapered surfaces on said spear body to urge said gripping elements into gripping engagement with the interior of the casing into which said apparatus is positioned.

5. An apparatus according to claim 4 wherein said cutter is flow actuated.

6. An apparatus according to claim 4 including means for preventing premature expansion of said gripping elements by said expanding means.

7. An apparatus according to claim 4 including, means for supporting said gripping elements in their retracted position on said spear body.

* * * * *